US009611580B2

(12) United States Patent
Gaddam

(10) Patent No.: US 9,611,580 B2
(45) Date of Patent: Apr. 4, 2017

(54) DEBRIS GUARD FOR A WASHING MACHINE

(71) Applicant: General Electric Company, Schenectady, NY (US)

(72) Inventor: Suresh Kumar Gaddam, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 125 days.

(21) Appl. No.: 14/520,752

(22) Filed: Oct. 22, 2014

(65) Prior Publication Data

US 2016/0115633 A1 Apr. 28, 2016

(51) Int. Cl.

| | |
|---|---|
| ***D06F 37/12*** | (2006.01) |
| ***D06F 17/06*** | (2006.01) |
| ***D06F 17/10*** | (2006.01) |
| ***D06F 23/04*** | (2006.01) |
| ***D06F 37/42*** | (2006.01) |
| ***D06F 39/08*** | (2006.01) |
| *D06F 39/10* | (2006.01) |

(52) U.S. Cl.

CPC ..... *D06F 37/12* (2013.01); *D06F 37/42* (2013.01); *D06F 39/083* (2013.01); *D06F 17/10* (2013.01); *D06F 39/08* (2013.01); *D06F 39/10* (2013.01)

(58) Field of Classification Search

CPC ..... D06F 17/06; D06F 17/10; D06F 23/04; D06F 37/12

See application file for complete search history.

(56) References Cited

U.S. PATENT DOCUMENTS

| | | | | | |
|---|---|---|---|---|---|
| 2,909,051 | A | * | 10/1959 | Altorfer | D06F 13/00 68/134 |
| 3,287,940 | A | * | 11/1966 | Gerhardt | D06F 39/10 68/18 FA |
| 3,330,137 | A | * | 7/1967 | Ketter | D06F 37/12 210/382 |
| 3,481,161 | A | * | 12/1969 | Wasemann | D06F 13/00 24/605 |
| 3,490,569 | A | * | 1/1970 | Reed | D06F 13/02 192/18 R |
| 3,772,925 | A | * | 11/1973 | Sisson | D06F 37/36 68/23.7 |
| 4,283,928 | A | * | 8/1981 | Stone | D06F 37/40 68/23.7 |

(Continued)

FOREIGN PATENT DOCUMENTS

| | | | |
|---|---|---|---|
| JP | 01064690 | A * | 3/1989 |
| JP | 11276756 | A | 10/1999 |
| KR | 20070090636 | A | 9/2007 |

*Primary Examiner* — Joseph L Perrin

(74) *Attorney, Agent, or Firm* — Dority & Manning, P.A.

(57) ABSTRACT

A washing machine appliance including a tub, a basket rotatably mounted within the tub, and an agitation element is provided. The agitation element defines a perimeter lip extending along an axial direction of the washing machine appliance towards a bottom wall of the basket. The bottom wall of the basket defines a ridge extending along the axial direction towards the agitation element. The ridge may be positioned inwardly of and proximate to the perimeter lip along a radial direction of the wash machine appliance to hinder debris from reaching a cavity defined between the agitation element and a bottom wall of the basket.

18 Claims, 4 Drawing Sheets

(56) References Cited

U.S. PATENT DOCUMENTS

| | | | | | |
|---|---|---|---|---|---|
| 4,444,027 | A * | 4/1984 | Ikeda | D06F 37/40 | 68/133 |
| 4,455,844 | A * | 6/1984 | McMillan | D06F 39/10 | 210/167.01 |
| 4,483,161 | A * | 11/1984 | Oida | D06F 23/04 | 68/23.6 |
| 4,837,882 | A * | 6/1989 | Brenner | D06F 37/40 | 192/18 R |
| 4,848,105 | A * | 7/1989 | O'Connell | D06F 39/10 | 210/167.01 |
| 5,018,372 | A * | 5/1991 | Altnau, Sr. | D06F 39/10 | 68/18 F |
| 5,921,114 | A * | 7/1999 | Jung | D06F 17/10 | 68/133 |
| 6,070,439 | A * | 6/2000 | Jung | D06F 17/10 | 68/134 |
| 6,202,451 | B1 * | 3/2001 | Park | D06F 37/40 | 68/133 |
| 8,516,859 | B2 | 8/2013 | Lalonde et al. | | |
| 9,127,394 | B2 * | 9/2015 | Tietz | D06F 39/10 | |
| 2013/0160217 | A1 | 6/2013 | Tietz et al. | | |
| 2015/0033803 | A1 * | 2/2015 | Carr | D06F 13/00 | 68/133 |

* cited by examiner

DEBRIS GUARD FOR A WASHING MACHINE

FIELD OF THE INVENTION

The present subject matter relates generally to a washing machine appliance, or more particularly, to a debris guard for a washing machine appliance.

BACKGROUND OF THE INVENTION

Washing machine appliances generally include a tub for containing a wash fluid, e.g., water and detergent, bleach, and/or other fluid additives. A basket is rotatably mounted within the tub and defines a wash chamber for receipt of articles for washing. During operation of such washing machine appliances, wash fluid is directed into the tub and onto articles within the wash chamber of the basket. The basket and/or an agitation element can rotate at various speeds to, e.g., agitate articles within the wash chamber, wring wash fluid from articles within the wash chamber, etc.

Articles that are commonly washed in washing machine appliances include articles of clothing with one or more pockets, such as shirts and pants. It is not uncommon for a user to fail to completely empty the pockets from such articles of clothing. Accordingly, such articles of clothing may be washed with, e.g., coins or other debris in the pockets. During washing operations, coins or other debris may be removed from the pockets of such articles of clothing, and settle on a bottom wall of the basket.

In certain instances, the coins or other debris may maneuver themselves between the agitation element and the bottom wall of the basket. Continued operation of the washing machine appliance can then cause such coins or other debris to "rattle" within the area between the agitation element the bottom wall of the basket. In certain washing machine appliance configurations, it may be difficult to remove the agitation element in order to reach and remove such coins or other debris. Accordingly, a wash machine appliance that can hinder coins or other debris from maneuvering themselves between the agitation element in the bottom wall the basket would be beneficial.

BRIEF DESCRIPTION OF THE INVENTION

Aspects and advantages of the invention are set forth below in the following description, or may be obvious from the description, or may be learned through practice of the invention.

In one exemplary embodiment of the present disclosure, a washing machine appliance is provided. The washing machine appliance defines an axial direction, a radial direction, and a circumferential direction. Additionally, the washing machine appliance includes a tub and a basket rotatably mounted within the tub. The basket includes a bottom wall and defines a wash chamber for receipt of articles for washing. The washing machine appliance also includes an agitation element disposed in the basket and including a perimeter lip. The perimeter lip extends along the axial direction towards the bottom wall of the basket. The bottom wall of the basket includes a ridge extending along the axial direction towards the agitation element and along the circumferential direction in a loop on the bottom wall. The ridge of the bottom wall is positioned inwardly of the perimeter lip along the radial direction to hinder debris from reaching a cavity defined between the agitation element and the bottom wall of the basket.

In another exemplary embodiment of the present disclosure, a washing machine appliance is provided, the washing machine appliance defining a vertical direction and a radial direction. The washing machine appliance includes a tub and a basket rotatably mounted within the tub. The basket includes a bottom wall and defines a wash chamber for receipt of articles for washing. The washing machine appliance also includes an agitation element disposed in the basket and including a perimeter lip. The perimeter lip extends downwardly along the vertical direction towards the bottom wall of the basket. The bottom wall of the basket includes a ridge extending upwardly along the vertical direction towards the agitation element. The ridge is positioned inwardly of the perimeter lip along the radial direction to hinder debris from reaching a cavity defined between the agitation element and the bottom wall of the basket.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
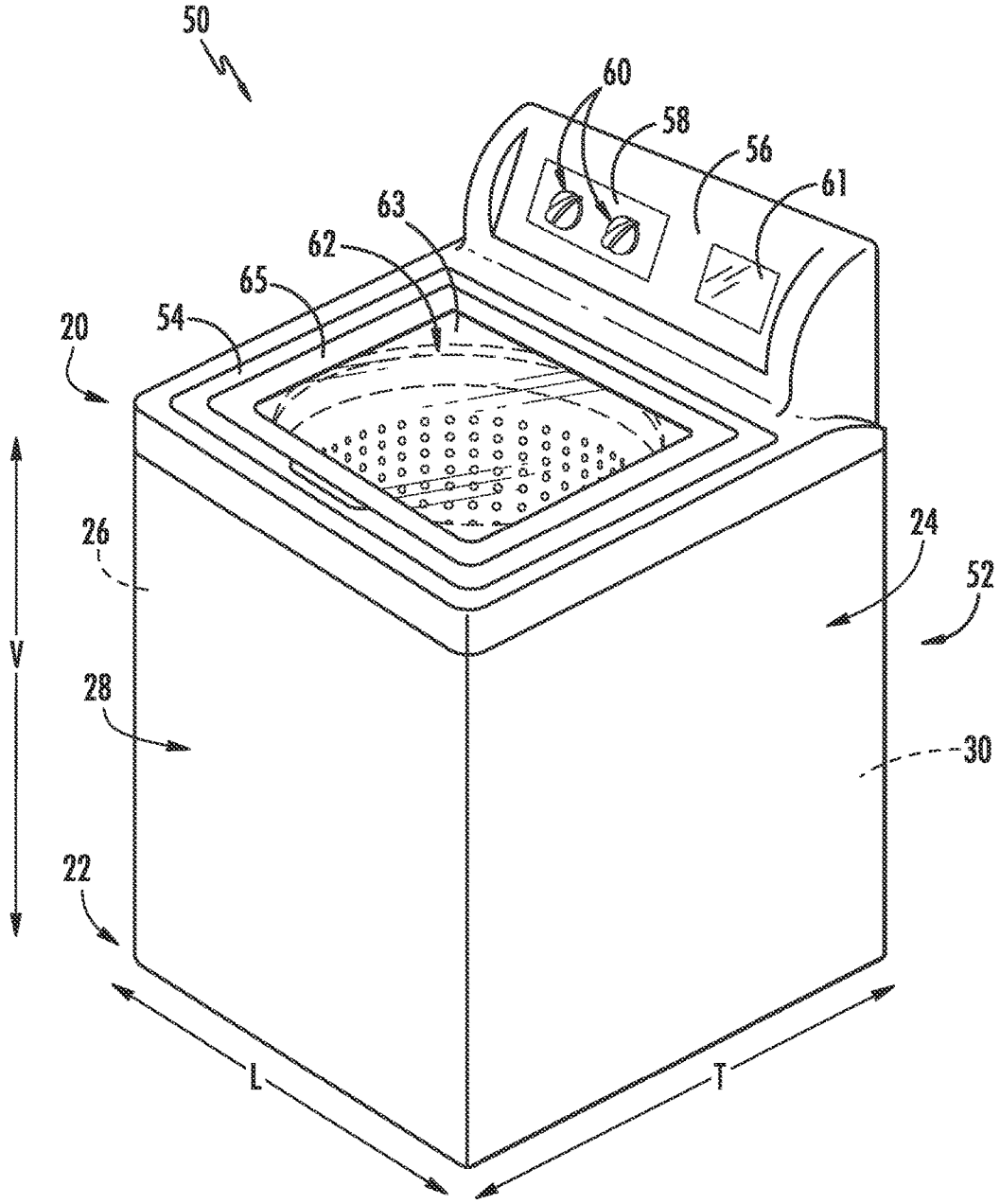
FIG. 1 provides a perspective view of a washing machine appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or descridgeed as part of one embodiment can be used with another embodiment to yield a still further embodiment. Thus, it is intended that the present invention covers such modifications and variations as come within the scope of the appended claims and their equivalents.

FIG. 1 is a perspective view of a washing machine appliance 50 according to an exemplary embodiment of the present subject matter. As depicted, washing machine appliance 50 defines a vertical direction V, a lateral direction L, and a transverse direction T. The vertical, lateral, and transverse directions V, L, T defined by washing machine appliance 50 are mutually perpendicular and together define an orthogonal direction system. Moreover, referring still to FIG. 1, the exemplary washing machine appliance 50 depicted extends generally along the vertical direction V between a top end 20 and a bottom end 22, along the lateral direction L between a first side 24 and a second side 26, and along the transverse direction T between a front side 28 and a rear side 30.

Referring still to FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other potential items of interest to machine users. A lid 62 is mounted to cover 54 and is rotatable between an open position (not shown) facilitating access to a wash tub 64 (FIG. 2) located within cabinet 52 and a closed position (shown in FIG. 1) forming an enclosure over tub 64.

Lid 62 in the exemplary embodiment depicted includes a transparent panel 63, which may be formed of, for example, glass, plastic, or any other suitable material. The transparency of the panel 63 allows users to see through the panel 63, and into the tub 64 when the lid 62 is in the closed position. In certain embodiments, the panel 63 may itself generally form the lid 62. In other embodiments, however, the lid 62 may include the panel 63 and a frame 65 surrounding and encasing the panel 63. Alternatively, panel 63 need not be transparent.

Figure 2:
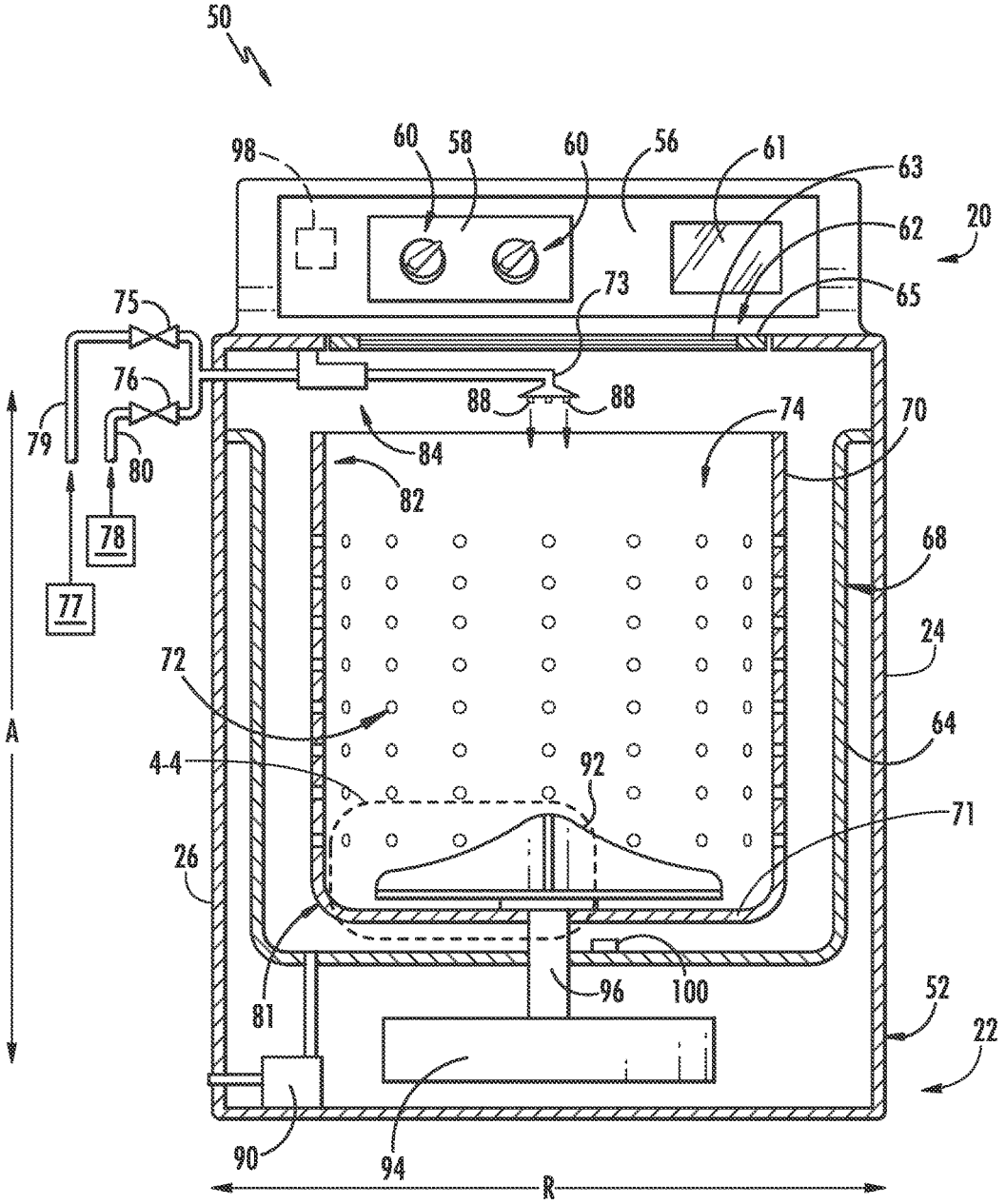
FIG. 2 provides a cross-sectional schematic view of the exemplary washing machine appliance of FIG. 1.

Referring now to FIG. 2, a cross-sectional, schematic view of the exemplary washing machine appliance 50 of FIG. 1 is provided. As shown, washing machine appliance 50 of FIG. 1 further defines an axial direction A, a radial direction R, and a circumferential direction C (see FIG. 3). For the embodiment depicted in FIG. 2, the axial direction A is parallel to the vertical direction V, shown above in FIG. 1.

As may be seen in FIG. 2, a wash drum or wash basket 70 is rotatably mounted within tub 64. Wash basket 70 includes a bottom wall 71 and defines a wash chamber 74 for receipt of articles for washing. Wash chamber 74 extends between a bottom portion 81 and a top portion 82 along the axial direction A, or more specifically along the vertical direction V. Basket 70 additionally includes a plurality of openings or perforations 71 therein to facilitate fluid communication between an interior of basket 70 and tub 64. Moreover, basket 70 is rotatable about axial direction A within tub 64, or more specifically about the vertical direction V. Accordingly, washing machine appliance 50 may be referred to as a "vertical axis washing machine appliance."

A nozzle 73 is configured for flowing a liquid into one or both of tub 64 and basket 70. In particular, nozzle 73 may be positioned at or adjacent to top portion 82 of basket 70. Nozzle 73 may be in fluid communication with a water source, or more specifically, to a hot water source 77 and a cold water source 78, in order to direct liquid (e.g., water) into tub 64 and/or onto articles within chamber 74 of basket 70. Nozzle 73 may further include apertures 88 through which water may be sprayed into the tub 64. Apertures 88 may, for example, be tubes extending from the nozzle 73, as illustrated, or alternatively may simply be holes defined in the nozzle 73. However, in other embodiments, apertures 88 may be any other suitable openings through which water may be sprayed. Further, nozzle 73 may additionally include other openings, holes, etc. (not shown) through which water may be flowed, i.e., sprayed or poured, into the tub 64 and/or basket 70.

Various valves may regulate the flow of fluid through nozzle 73. For example, a hot water valve 75 and a cold water valve 76 may be utilized to flow hot water and cold water, respectively, therethrough. Each valve 75, 76 can selectively adjust to a closed position in order to terminate or obstruct the flow of fluid therethrough to nozzle 73. The hot water valve 75 may be in fluid communication with a hot water source 77, which may be external to the washing machine appliance 50. The cold water valve 76 may be in fluid communication with a cold water source 78, which may be external to the washing machine appliance 50. The cold water source 78 may, for example, be a commercial water supply, while the hot water source 77 may be, for example, a water heater. Such water sources 77, 78 may supply water to the appliance 50 through the respective valves 75, 76. A hot water conduit 79 and a cold water conduit 80 may supply hot and cold water, respectively, from the sources 77, 78 through the respective valves 75, 76 and to the nozzle 73.

An additive dispenser 84 may additionally be provided for directing a wash additive, such as detergent, bleach, liquid fabric softener, etc., into the tub 64. For example, dispenser 84 may be in fluid communication with nozzle 73 such that water flowing through nozzle 73 flows through dispenser 84, mixing with wash additive at a desired time during operation to form a liquid or wash fluid, before being flowed into tub 64. In some embodiments, nozzle 73 is a separate downstream component from dispenser 84. In other embodiments, nozzle 73 and dispenser 84 may be integral, with a portion of dispenser 84 serving as the nozzle 73. A pump assembly 90 is located beneath tub 64 and basket 70 for gravity assisted flow to drain tub 64.

An agitation element 92, shown schematically as an impeller in FIG. 2, may be disposed in basket 70 to impart an oscillatory motion to articles and liquid in chamber 74 of basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 92 is oriented to rotate about the axial direction A. Basket 70 and agitation element 92 are driven by a motor 94, such as a pancake motor, rotating a motor output shaft 96. As motor output shaft 96 is rotated, basket 70 and agitation element 92 are operated for rotatable movement within tub 64, e.g., about axial direction A. Washing machine appliance 50 may also include a brake assembly (not shown) selectively applied or released for respectively maintaining basket 70 in a stationary position within tub 64 or for allowing basket 70 to spin within tub 64. Notably, agitation element 92 and bottom wall 71 of wash basket 70 are depicted schematically in FIG. 2, and will be described in greater detail below with reference to FIGS. 3 through 5.

Various sensors may additionally be included in the washing machine appliance 50. For example, a pressure sensor 100 may be positioned in the tub 64 as illustrated. Any suitable pressure sensor 100, such as an electronic sensor, a manometer, or another suitable gauge or sensor, may be utilized. The pressure sensor 100 may generally measure the pressure of water in the tub 64. This pressure can then be utilized to estimate the height or level of water in the tub 64. Additionally, a suitable speed sensor can be connected to the motor 94, such as to the output shaft 96 thereof, to measure speed and indicate operation of the motor 94. Other suitable sensors, such as temperature sensors, etc., may additionally be provided in the washing machine appliance 50.

Operation of washing machine appliance 50 is controlled by a processing device or controller 98, that is operatively coupled to the input selectors 60 located on washing machine backsplash 56 (shown in FIG. 1) for user manipulation to select washing machine cycles and features. Controller 98 may further be operatively coupled to various other components of appliance 50, such as valves 75, 76, motor 94, pressure sensor 100, and other suitable sensors, etc. In response to user manipulation of the input selectors 60, controller 98 may operate the various components of washing machine appliance 50 to execute selected machine cycles and features.

Controller 98 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 98 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 98 via one or more signal lines or shared communication busses.

In an illustrative embodiment, a load of laundry articles are loaded into chamber 74 of basket 70, and washing operation is initiated through operator manipulation of control input selectors 60. Tub 64 is filled with water and mixed with detergent to form a liquid or wash fluid. Valves 75, 76 can be opened to initiate a flow of water into tub 64 via nozzle 73, and tub 64 can be filled to the appropriate level for the amount of articles being washed. Once tub 64 is properly filled with wash fluid, the contents of the basket 70 are agitated with agitation element 92 or by movement of the basket 70 for cleaning of articles in basket 70. More specifically, agitation element 92 or basket 70 is moved back and forth in an oscillatory motion.

After the agitation phase of the wash cycle is completed, tub 64 is drained. Laundry articles can then be rinsed by again adding fluid to tub 64, depending on the particulars of the cleaning cycle selected by a user, agitation element 92 or basket 70 may again provide agitation within basket 70. One or more spin cycles may also be used. In particular, a spin cycle may be applied after the wash cycle and/or after the rinse cycle in order to wring wash fluid from the articles being washed. During a spin cycle, basket 70 is rotated at relatively high speeds.

While described in the context of specific embodiments of washing machine appliance 50, using the teachings disclosed herein it will be understood that washing machine appliance 50 is provided by way of example only. Other washing machine appliances having different configurations, different appearances, and/or different features may also be utilized with the present subject matter as well.

Figure 3:
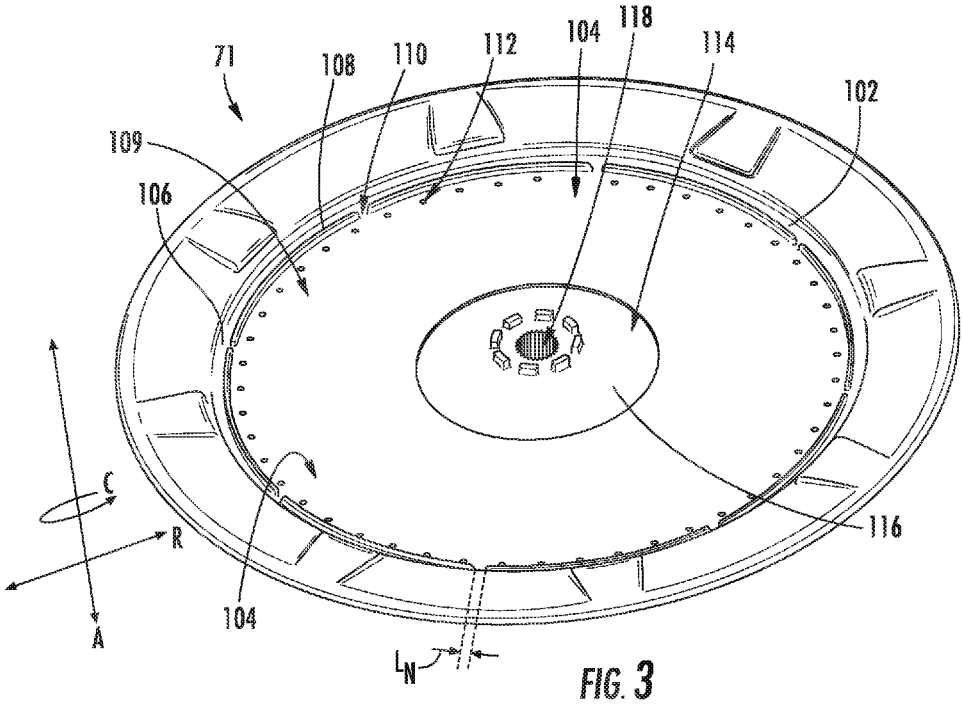
FIG. 3 provides a perspective view of a bottom wall of a wash basket of the exemplary washing machine appliance of FIG. 1.

Referring now to FIG. 3, a perspective view of bottom wall 71 of wash basket 70 depicted schematically in FIG. 2 is provided in greater detail. For the exemplary embodiment depicted, bottom wall 71 of wash basket 70 includes a sloped outer portion 102 and a circular indentation 104. Sloped outer portion 102 leads to circular indentation 104 and circular indentation 104 includes a peripheral embankment 106 along a circumference of the circular indentation 104. Further, bottom wall 71 of wash basket 70 includes a ridge 108 positioned inward of peripheral embankment 106 along the radial direction R, within circular indentation 104. Ridge 108 extends along the axial direction A away from a surface 109 of bottom wall 71, and also extends along the circumferential direction C in a loop on surface 109 of bottom wall 71. More particularly, ridge 108 extends along the circumferential direction C approximately three hundred and sixty degrees completely around a radially inner portion of bottom wall 71. It should be appreciated that as used herein, terms of approximation, such as "approximately," "about," or "substantially," refer to being within a 10% margin of error.

In certain exemplary embodiments, ridge 108 may be formed integrally with bottom wall 71 of wash basket 70, such that there are no seams, gaps, or separations between, e.g., surface 109 and ridge 108. However, in other embodiments, ridge 108 may instead be attached to surface 109 of bottom wall 71 using any suitable attachment means. For example, ridge 108 may be attached to surface 109 of bottom wall 71 using, e.g., epoxy, welding, or a suitable mechanical attachment mechanism, such as one or more screws or bolts.

Ridge 108 of bottom wall 71 defines a plurality of notches 110, and thus may not extend continuously along the circumferential direction C. In certain exemplary embodiments, each of the plurality of notches 110 may define a length $L_N$ along the circumferential direction C of less than or equal to about three quarters (¾) of an inch. However, in other embodiments, the plurality of notches 110 may instead define a length $L_N$ along the circumferential direction C of less than or equal to about one half (½) of an inch, or less than or equal to about one quarter (¼) of an inch. With such a configuration, a flow of liquid between adjacent portions of ridge 108 may be allowed, while ridge 108 may still act to stop debris from traveling inward along radial direction R during operation of washing machine appliance 50.

Bottom wall 71 depicted in FIG. 3 further defines a plurality of drain holes 112 positioned inside ridge 108 of bottom wall 71 along radial direction R. For the embodiment depicted, drain holes 112 are spaced along the circumferential direction C in a complete circle on bottom wall 71. In other exemplary embodiments, however, any other suitable drain features may be provided. For example, in other embodiments, bottom wall 71 of wash basket may additionally or alternatively include a plurality of drain slots or grates positioned inwardly of ridge 108 along radial direction R.

Bottom wall 71 further defines a central circular opening 114 at a radially inward portion, with a hub 116 extending therethrough. Hub 116 is attached to bottom wall 71 and is in mechanical communication with a motor (not shown) of washing machine appliance 50. Further, hub 116 is configured to rotate bottom wall 71 and wash basket 70 within tub 64 during certain operations of washing machine appliance 50. For the embodiment depicted, hub 116 defines a first geared socket 118 for receipt of a shaft (not shown), which may in certain embodiments be motor output shaft 98 of motor 94.

Bottom wall 71 having such a configuration may direct a flow of liquid from sloped outer portion 102, down peripheral embankment 106 of circular indentation 104, through the plurality of notches 110 in ridge 108 of bottom wall 71, and out through the plurality of drain holes 112. Such a configuration may prevent stagnation of wash liquid within wash basket 70 of wash machine appliance 50.

Figure 4:
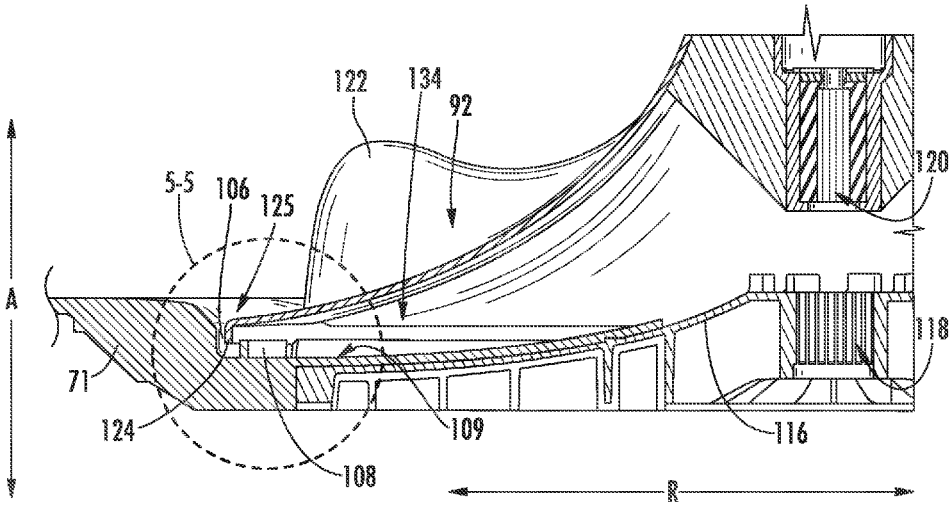
FIG. 4 provides a cross-sectional view of a portion of an agitation element and the bottom wall of the exemplary washing machine appliance of FIG. 1.
Figure 5:
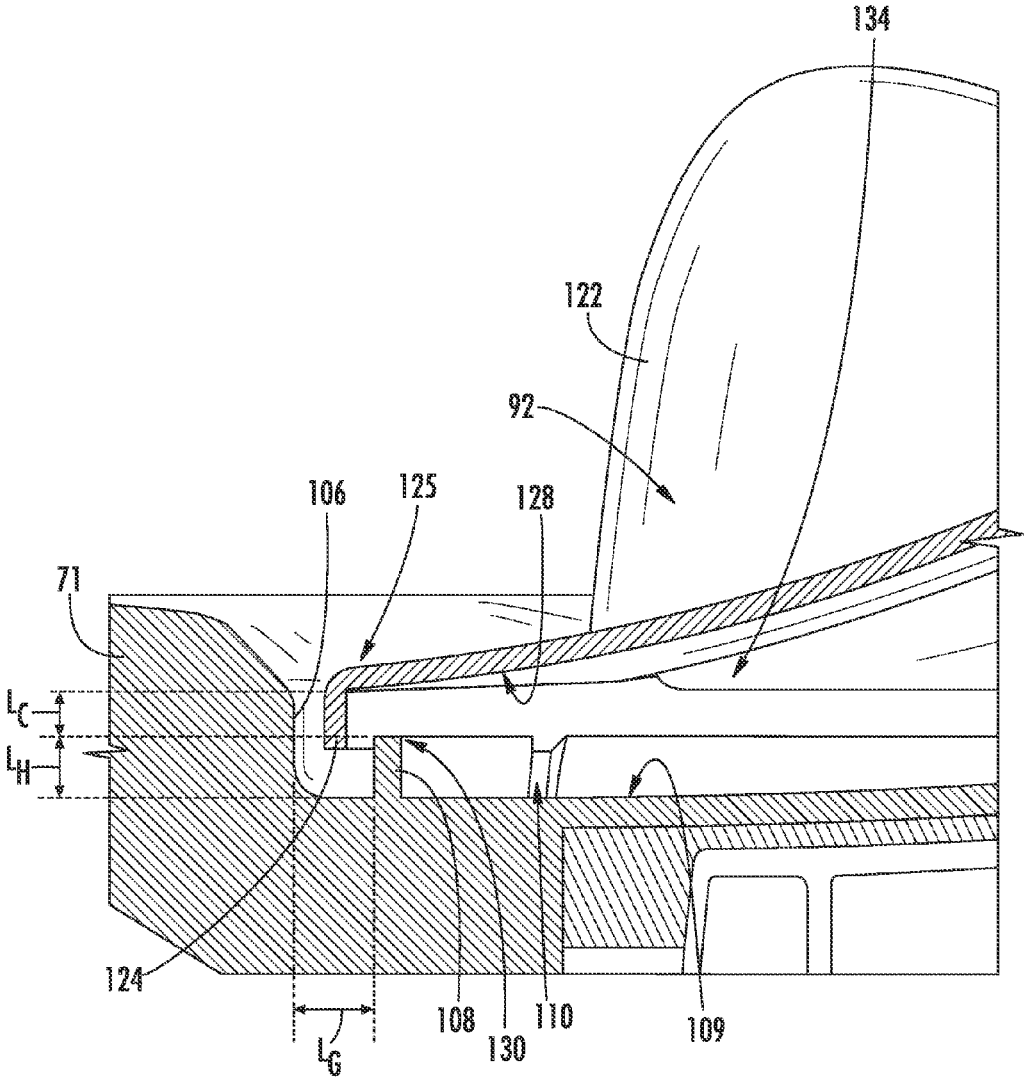
FIG. 5 provides a close-up cross-sectional view of Section 5-5 in FIG. 4.

Referring now to FIGS. 4 and 5, close-up cross-sectional views of bottom wall 71 and agitation element 92 depicted schematically in FIG. 2 are provided. More particularly, FIG. 4 provides a close-up cross-sectional view of Section 4-4 of FIG. 2, and FIG. 5 provides a close up cross-sectional view of Section 5-5 of FIG. 4.

Agitation element 92 is positioned at least partially within wash chamber 74 and includes a second geared socket 120 for receipt of a driveshaft (not shown). The driveshaft may, e.g., extend through the motor shaft in mechanical communication with hub 116 via first geared socket 118, or alternatively may be an extension of the motor shaft in mechanical communication with hub 116 via first geared socket 118. Additionally, the driveshaft may be configured to rotate independently of the motor shaft in mechanical communication with hub via first geared socket 118, such that agitation element 92 is rotatable independently of and relative to bottom wall 71 of wash chamber 70.

Referring still to FIGS. 4 and 5, agitation element 92 additionally includes one or more fins 122 configured to assist in agitating the articles and/or wash liquid in wash chamber 74, and a perimeter lip 124. Perimeter lip 124 extends along the circumferential direction C around a radially outer edge 125 of agitation element 92. Additionally, perimeter lip 124 extends along the axial direction A towards bottom wall 71 of basket 70. Perimeter lip 124 is positioned proximate to ridge 108 of bottom wall 71 of basket 70. As stated, ridge 108 also extends along the axial direction A. However, ridge 108 extends along the axial direction A away from surface 109 and towards agitation element 92. For example, when configured with wash machine appliance 50 of FIGS. 1 and 2, perimeter lip 124 of agitation element 92 may extend downwardly along the vertical direction V towards bottom wall 71 of wash basket 70, and ridge 108 may extend upwardly along the vertical direction V towards agitation element 92.

As is depicted, perimeter lip 124 of agitation element 92 is positioned between peripheral embankment 106 of the circular indentation 104 of bottom wall 71 and ridge 108 of bottom wall 71 along the radial direction R. Accordingly, for the embodiment depicted, perimeter lip 124 is positioned inwardly of and proximate to peripheral embankment 106 along radial direction R, and ridge 108 is positioned inwardly of and proximate to perimeter lip 124 along radial direction R.

Referring now specifically to FIG. 5, ridge 108 of bottom wall 71 defines a height $L_H$ along the axial direction A relative to surface 109, which may in certain exemplary embodiments, be at least about one quarter (¼) of an inch. However, in other embodiments, ridge 108 may instead define a height $L_H$ along axial direction A of at least about one half (½) of an inch, or of at least about three quarters (¾) of an inch. Additionally, as depicted in FIG. 5, ridge 108 of bottom wall 71 and peripheral embankment 106 of the circular indentation 104 defined by bottom wall 71 together define a gap $L_G$ therebetween. In certain exemplary embodiments, the gap $L_G$ may be less than or equal to about one and one quarter (1¼) of an inch. However, in other exemplary embodiments, gap $L_G$ defined between peripheral embankment 106 and ridge 108 may instead be less than or equal to about one (1) inch, less than or equal to about three quarters (¾) of an inch, or less than or equal to about one half (½) of an inch. Notably, for the embodiment depicted, perimeter lip 124 of agitation element 92 extends along the axial direction A at least partially into gap $L_G$ defined between peripheral embankment 106 and ridge 108.

Referring still to FIG. 5, agitation element 92 is configured such that a bottom surface 128 of agitation element 92 is spaced along the axial direction A above a top end 130 of ridge 108 of bottom wall 71. For example, in certain embodiments ridge 108 of bottom wall 71 and bottom surface 128 of agitation element 92 may define a clearance $L_C$ along the axial direction A. The clearance $L_C$ may be between about one eighth (⅛) of an inch and about one (1) inch. More specifically, the clearance $L_C$ may be between about one quarter (¼) of an inch and three quarters (¾) of an inch. Such a configuration may prevent undesirable contact between ridge 108 and agitation element 92. For example, the clearance $L_C$ may be set such that an anticipated amount of elastic deformation of agitation element 92 due to, e.g., a force exerted thereon by a load of articles positioned in wash chamber 74, will not cause agitation element 92 to contact top end of ridge 108.

It should be appreciated, however, that the agitation element 92 and bottom wall 71 depicted are by way of example only, and that in other exemplary embodiments, agitation element 92 and bottom wall 71 may have any other suitable configuration. For example, although ridge 108 is depicted generally defining a substantially rectangular cross-sectional shape, in other exemplary embodiments, ridge 108 may instead define any other suitable cross-sectional shape. For example, in other exemplary embodiments, ridge 108 may instead define a triangular cross-sectional shape, a parabolic cross-sectional shape, or any other suitable cross-sectional shape. Similarly, although peripheral embankment 106 is depicted generally defining a vertical edge, in other exemplary embodiments, peripheral embankment 106 may instead define any other suitable shape/slope. For example, in other exemplary embodiments, peripheral embankment 106 may instead define a more gradual slope towards surface 109 of bottom wall 71. Alternatively, in other exemplary embodiments of the present disclosure, bottom wall 71 may not include circular indentation 104, and thus may not include peripheral embankment 106. Moreover, it should be appreciated that the measurements provided for, e.g., length $L_N$ of notches 110 in ridge 108, height $L_H$ of ridge 108 relative to surface 109, gap $L_G$ between ridge 108 and peripheral embankment 106, and clearance $L_C$ between top portion 130 of ridge 108 and bottom surface 128 of agitation member 92 are all provided by way of example only. In other exemplary embodiments, any other suitable length $L_N$, height $L_H$, gap $L_G$, or clearance $L_C$ may be defined by bottom wall 71 and/or agitation element 92.

A washing machine appliance 50 including a wash basket 70 with a bottom wall 71 and an agitation element 92 in accordance with the present disclosure may hinder debris, such as coins, from reaching a cavity 134 defined between agitation element 92 and bottom wall 71 of basket 70. More particularly, inclusion of ridge 108 on bottom wall 71 of wash basket 70 proximate to perimeter lip 124 of agitation element 92 may hinder debris, such as coins, from traveling or maneuvering underneath perimeter lip 124 of agitation element 92 into chamber 134 defined between bottom wall 71 and agitation element 92.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal language of the claims.

What is claimed:

1. A washing machine appliance defining an axial direction, a radial direction, and a circumferential direction, the washing machine appliance comprising:

a tub;

a basket rotatably mounted within the tub and including a bottom wall, the basket defining a wash chamber for receipt of articles for washing; and an agitation element disposed in the basket and including a perimeter lip, the perimeter lip extending along the axial direction towards the bottom wall of the basket, the bottom wall of the basket including a ridge extending substantially parallel to the axial direction towards the agitation element and along the circumferential direction in a loop on the bottom wall, the ridge of the bottom wall positioned inwardly of the perimeter lip along the radial direction and proximate to the perimeter lip to hinder debris from reaching a cavity defined between the agitation element and the bottom wall of the basket, wherein the ridge of the bottom wall defines a plurality of notches configured to allow fluid to flow between adjacent portions of the ridge and to the cavity defined between the agitation element and the bottom wall of the basket.

2. The washing machine appliance of claim 1, wherein the bottom wall defines a circular indentation with a peripheral embankment along a circumference of the circular indentation.

3. The washing machine appliance of claim 2, wherein the perimeter lip of the agitation element is positioned between the peripheral embankment of the circular indentation defined in the bottom wall and the ridge of the bottom wall along the radial direction.

4. The washing machine appliance of claim 2, wherein the peripheral embankment of the circular indentation defined in the bottom wall and the ridge of the bottom wall define a gap along the radial direction, the gap being less than or equal to about three-quarters of an inch.

5. The washing machine appliance of claim 1, wherein the plurality of notches each define a length along the circumferential direction of less than about three quarters of an inch.

6. The washing machine appliance of claim 1, wherein the bottom wall of the basket defines a plurality of drain holes positioned inside the ridge of the bottom wall along the radial direction.

7. The washing machine appliance of claim 1, wherein the agitation element defines a bottom surface, wherein the ridge of the bottom wall defines a top end, wherein the top end of the ridge and the bottom surface of the agitation element define a clearance along the axial direction, and wherein the clearance is between about one eighth of an inch and about three quarters of an inch.

8. The washing machine appliance of claim 1, wherein the ridge of the bottom wall defines a height along the axial direction of at least about one quarter of an inch.

9. The washing machine appliance of claim 1, wherein the ridge is formed integrally with the bottom wall of the basket.

10. A washing machine appliance defining a vertical direction and a radial direction, the washing machine appliance comprising:

a tub;

a basket rotatably mounted within the tub and including a bottom wall, the basket defining a wash chamber for receipt of articles for washing; and an agitation element disposed in the basket and including a perimeter lip, the perimeter lip extending downwardly along the vertical direction towards the bottom wall of the basket, the bottom wall of the basket including a ridge extending upwardly substantially parallel to the vertical direction towards the agitation element, the ridge positioned inwardly of the perimeter lip along the radial direction and proximate to the perimeter lip to hinder debris from reaching a cavity defined between the agitation element and the bottom wall of the basket, wherein the ridge of the bottom wall defines a plurality of notches configured to allow fluid to flow between adjacent portions of the ridge and to the cavity defined between the agitation element and the bottom wall of the basket.

11. The washing machine appliance of claim 10, wherein the bottom wall defines a circular indentation with a peripheral embankment along a circumference of the circular indentation.

12. The washing machine appliance of claim 11, wherein the perimeter lip of the agitation element is positioned between the peripheral embankment of the circular indentation defined in the bottom wall and the ridge of the bottom wall along the radial direction.

13. The washing machine appliance of claim 11, wherein the peripheral embankment of the circular indentation defined in the bottom wall and the ridge of the bottom wall define a gap along the radial direction, the gap being less than or equal to about three-quarters of an inch.

14. The washing machine appliance of claim 10, wherein the washing machine appliance further defines a circumferential direction, and wherein the plurality of notches each define a length along the circumferential direction of less than about three quarters of an inch.

15. The washing machine appliance of claim 10, wherein the bottom wall of the basket defines a plurality of drain holes positioned inside the ridge of the bottom wall along the radial direction.

16. The washing machine appliance of claim 10, wherein the agitation element defines a bottom surface, wherein the ridge of the bottom wall defines a top end, wherein the top end of the ridge and the bottom surface of the agitation element define a clearance along the vertical direction, and wherein the clearance is between about one eighth of an inch and about three quarters of an inch.

17. The washing machine appliance of claim 10, wherein the ridge of the bottom wall defines a height along the vertical direction of at least about one quarter of an inch.

18. The washing machine appliance of claim 10, wherein the ridge is formed integrally with the bottom wall of the basket.

* * * * *